United States Patent [19]

Inouye et al.

[11] 4,324,368

[45] Apr. 13, 1982

[54] YARN WINDING APPARATUS

[75] Inventors: Yoshinori Inouye; Tadahiko Ohkubo, both of Ootsu, Japan

[73] Assignee: Toray Industries, Inc., Tokyo, Japan

[21] Appl. No.: 130,114

[22] Filed: Mar. 13, 1980

[30] Foreign Application Priority Data

Mar. 15, 1979 [JP] Japan ..... 54-30436

[51] Int. Cl.[3] ..... B65H 54/02; B65H 54/34

[52] U.S. Cl. ..... 242/18 PW; 242/18 EW

[58] Field of Search ..... 242/18 PW, 18 EW, 18 R, 242/18 DD, 18 A, 35.5 A, 41

[56] References Cited

U.S. PATENT DOCUMENTS

| | | | |
|---|---|---|---|
| 3,090,570 | 5/1963 | Cunningham et al. | 242/18 A |
| 3,310,247 | 3/1967 | Emery | 242/18 A |
| 3,355,117 | 11/1967 | Gerhardt et al. | 242/18 A |
| 3,385,532 | 5/1968 | Sparling | 242/18 PW |
| 3,940,075 | 2/1976 | Lenk | 242/18 PW |
| 4,033,519 | 7/1977 | Abe et al. | 242/18 A |
| 4,052,017 | 10/1977 | Schar | 242/35.5 A |
| 4,057,195 | 11/1977 | Jones et al. | 242/18 A X |
| 4,069,983 | 1/1978 | Muramatsu et al. | 242/18 PW |
| 4,166,586 | 9/1979 | Shirasuna et al. | 242/18 PW |
| 4,186,890 | 2/1980 | Miller | 242/18 PW X |

*Primary Examiner*—Stanley N. Gilreath
*Attorney, Agent, or Firm*—Austin R. Miller

[57] ABSTRACT

An apparatus for winding a yarn on a bobbin comprising: a guide for serving as a fulcrum of the traverse motion of yarn; a mechanism for positively driving and holding the bobbin; a traverse mechanism which is provided with a traverse guide having a narrow opening and a wide yarn holding portion and which reciprocates the traverse guide along the direction of the generatrix of said bobbin so as to form a yarn package on the bobbin; a yarn catching guide which includes a slope inclining with respect to the moving direction of the traverse guide and a hook portion connected to the upper end of the slope, the bottom of the hook portion being located at a position higher than the opening of said traverse guide; and the yarn catching guide being adjacent to the traverse guide and arranged movably along the moving direction of the traverse guide so that the slope of the yarn catching guide intersects the traverse region wherein the yarn is moved to and fro in accordance with the movement of the traverse guide and so that the hook portion reaches a position located above the traverse region.

16 Claims, 22 Drawing Figures

5
3
2
45a
17
16
18
10
9
45
7
8

YARN WINDING APPARATUS

FIELD TO WHICH THE INVENTION RELATES

The present invention relates to a yarn winding apparatus wherein a yarn is supplied to a rotating bobbin while the yarn is traversed to and fro along the bobbin so as to form a yarn package by winding the yarn onto the bobbin. More particularly, the present invention relates to a yarn winding apparatus utilized in textile machinery, such as a drawing machine, a draw-texturing machine, a false-twisting machine and a spinning frame, and the apparatus is provided with a yarn catching guide by which a yarn having been forcedly traversed by means of a traverse mechanism is grasped easily and rapidly without causing any damage to the yarn when the yarn is commenced to be wound or when a bobbin is replaced by a new bobbin in the yarn winding apparatus.

In a type yarn winding apparatus or a yarn winding apparatus which is provided with a waste spool arranged adjacent to the end of the bobbin, when a yarn package formed on the bobbin reaches a predetermined full amount, it is necessary to remove a yarn which has been held by a traverse guide from the traverse guide and move the yarn to the end of the bobbin in order to replace the full bobbin with an empty bobbin. Furthermore, in another type yarn winding apparatus, when a yarn is commenced to be wound onto an empty bobbin, in order to form a transfer tail, it is necessary to remove a yarn which is connected to a full bobbin from a traverse guide, catch the yarn and move it to a position whereby a transfer tail is formed and wound on an end portion of an empty bobbin.

PRIOR ART OF THE INVENTION

Japanese Pat. No. 25454/77 discloses a yarn winding apparatus by which the requirements described above can be satisfied. More specifically, the Japanese Patent Publication discloses a mechanism wherein a movable guide provided with a slope inclining with respect to the moving direction of a traverse guide is moved along the traverse direction of the traverse guide beyond the moving region of the traverse guide so that the slope of the movable guide scoops a yarn from a yarn holding portion of the traverse guide.

However, the stroke length of the movable guide in that Japanese patent is longer than the moving region, and accordingly, the entire mechanism is large. In addition, if the moving speed of the movable guide is not higher than that of the traverse guide, there occurs a phenomenon in that the yarn which has once been removed from the traverse guide may be again caught by the traverse guide, and accordingly, the yarn is subjected to a fluctuation which is unnecessary to the yarn, and as a result, there is a defect in that the quality of the yarn is degraded. To avoid the above-mentioned defect, the movable guide must be moved at a high speed which is substantially equal to the moving speed of the traverse guide. There is another defect in that large parts and a complicated mechanism are necessary in order to move the movable guide at such a high speed.

Contrary to this, Japanese Pat. No. 38146/77 discloses a yarn winding apparatus provided with a mechanism for continuously winding a supply yarn by transferring a yarn from a bobbin to a waste spool, the peripheral speed of which is synchronized with the peripheral speed of the bobbin and vice versa.

However, the apparatus in the latter Japanese Publication utilizes a movable guide by which a yarn is transferred between the waste spool and the bobbin. Since the yarn is taken from place to place by the guide, an unstable tension region is caused in the yarn where the tension in the yarn may be excessively high or low. Due to the unstable tension region, the yarn transferring operation may be unstable. The phenomenon will now be explained in detail. When a yarn is transferred from a bobbin to a waste spool by utilizing a guide, there is a step wherein the yarn falls from the surface of the yarn package to the end of the bobbin. It should be noted that the peripheral speed of the end portion of the bobbin is smaller than that of the surface of the yarn package, and accordingly, an unpreferable phenomenon occurs in that the yarn slackening is unavoidable. The amount of the slack is large when the diameter of the yarn package is large.

On the contrary, when the yarn is transferred from the waste spool to an empty bobbin by utilizing a guide, due to the reason similar to that mentioned above, the yarn slackens. In addition, if a yarn is deflected sharply around a guide or the like, the tension in the yarn located at the guide may be excessively increased. When the yarn slackens, not only the yarn transferring operation is unsure, but also the formation of the transfer tail on a new bobbin is inferior. Furthermore, the yarn is not caught immediately and perfectly, and as a result, failure in the traverse motion of the yarn may occur.

If the tension in the yarn is too high, the yarn may easily be broken when the yarn is transferred, and accordingly, the continuous treatment of the yarn is prevented. Breakage of the yarn occurs when the elongation of the yarn is small or when the winding speed is high.

BRIEF SUMMARY OF THE INVENTION

An object of the present invention is to provide a yarn winding apparatus provided with a yarn catching guide which has a simple construction and by which a yarn, held by a traverse guide and traversed thereby, is grasped.

To achieve the above-mentioned object, the present invention has the following construction.

An apparatus for winding a yarn on a bobbin comprising:

- a guide for serving as a fulcrum of the traverse motion of a yarn;
- a mechanism for positively driving and holding said bobbin;
- a traverse mechanism which is provided with a traverse guide having a narrow opening and a wide yarn holding portion and which traverses along the direction of the generatrix of said bobbin to and fro, so as to form a yarn package on said bobbin;
- a yarn catching guide which includes a slope inclining with respect to the moving direction of said traverse guide and a hook portion connected to the upper end of said slope, the bottom of said hook portion being located at a position higher than said opening of said traverse guide; and
- said yarn catching guide being adjacent to said traverse guide and arranged movably along the said moving direction of said traverse guide so that said slope of said yarn catching guide intersects the traverse region wherein said yarn is moved to and fro in accordance with the movement of said traverse guide and so that said hook portion reaches a position located above said traverse region.

According to embodiments of the present invention, the following effects can be obtained when transferring a yarn from a bobbin to a waste spool or vice versa.

The yarn transferring operation can be carried out stably and without fail because a yarn slack or excessive yarn tension will not occur during the yarn transferring process.

The yarn transferring operation can be effected almost without any influence from the diameter of a yarn package, the elasticity of the yarn, the winding speed, and so on.

Yarn transferring can be carried out with only one operation. Even if a winding speed at which a yarn is wound on a bobbin is changed to some extent or if the diameter of a yarn package is changed, it is not necessary to change the moving speed of the yarn catching guide. Compared with a conventional apparatus, the moving distance of a yarn catching guide of the present invention is shorter, so that the apparatus of the present invention can be compacted. The operation of the apparatus of the present invention is easy. In the apparatus of the present invention, a plurality of yarn catching guides can be driven by one driving mechanism, which is very advantageous for simultaneous doffing.

When transferring a yarn from a waste spool to a bobbin, a transfer tail winding having a predetermined length can be formed on one end of a bobbin under a stable yarn tension by provision of a groove in the fixed guide.

After forming a transfer tail winding, the yarn is released from the groove in a fixed guide, and then it is immediately caught by a yarn holding portion of a traverse guide during one reciprocation of the traverse guide, so that the normal traverse motion is started. Consequently, the innermost layer of a yarn package is formed with normal traverse motion, i.e. there is no disorder in yarn distribution. Therefore when a yarn package is unwound in a successive treating process, the yarn is smoothly and stably unwound to the innermost layer.

A yarn to be wound on a bobbin does not touch any obstacles, such as a yarn catching guide, etc., until the yarn package becomes full.

BRIEF DESCRIPTION OF THE DRAWINGS

Some embodiments of the present invention will now be explained in detail with reference to the accompanying drawings, wherein.

DETAILED DESCRIPTION OF PREFERRED EMBODIMENTS OF THE INVENTION

Figure 1:
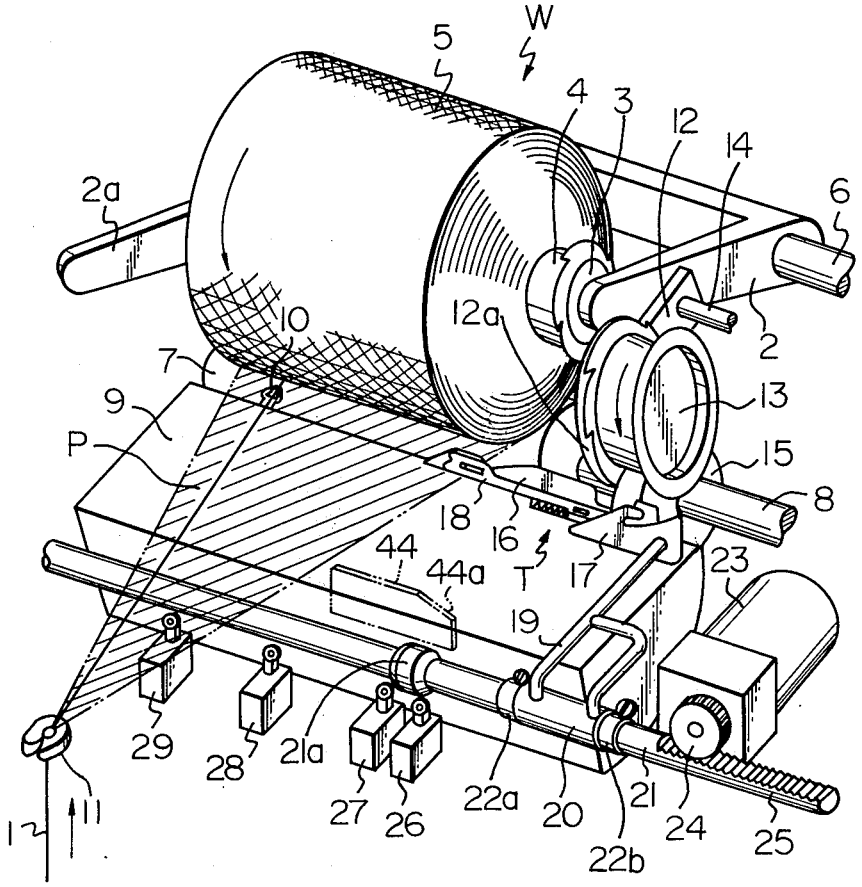
FIG. 1 is a perspective view of a yarn winding apparatus according to the present invention.
Figure 2:
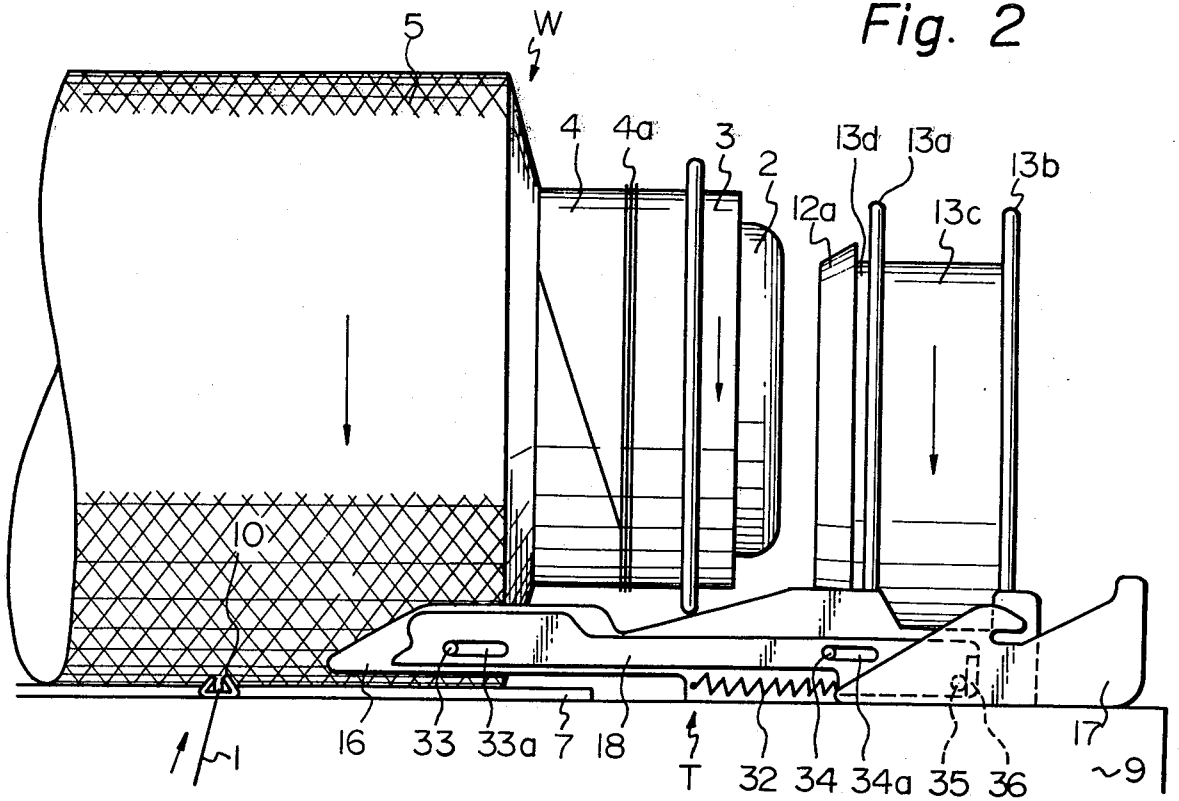
FIG. 2 is an elevational view of the yarn winding apparatus illustrated in FIG. 1.

As shown in FIGS. 1 and 2, a yarn winding apparatus of the present invention includes a winding section W and a yarn transferring section T. Main parts in the winding section W are a means for driving a bobbin, including a spindle composed of a cradle 2, a bobbin chuck 3, a bobbin 4 supported by the spindle, and a bobbin driving roller 7; a traverse mechanism comprising a cam box 9 and a traverse guide 10 driven by a cam (not illustrated) provided in the cam box; a guide 11 serving as a fulcrum of the traverse motion of a yarn (hereinafter such a guide is referred to as a fulcrum guide); and a means for driving a waste spool, including a waste spool 13 for temporarily winding a yarn, which will be wasted, and a waste spool driving disk 15. In the yarn transferring region T, there is a means for transferring a yarn, including a fixed guide 16, a yarn catching guide 17 and a movable guide 18.

A pair of arms of the cradle 2 are pivotably supported by a shaft 6. A bobbin 4 is rotatably supported at both ends by the cradle via a bobbin chuck 3. One of the arms of the cradle 2 is formed as a lever **2*a* which is movable toward and away from the other cradle so that the bobbin can be attached to or detached from the cradle. The bobbin driving roller 7 and the waste spool driving disk 15 are fixed onto a rotary shaft 8 which is positively driven by a driving source (not illustrated), so that they are positively driven by the shaft 8. Preferably, the diameter of the waste spool driving disk 15 is slightly larger than that of the bobbin driving roller 7. The bobbin 4 and the waste spool 13 are, respectively, pressed to the bobbin driving roller 7 and the waste spool driving disk 15**, so that they are surface-driven.

The cam box 9 causes the traverse guide 10 to move backwards and forwards alternately in a direction substantially parallel to the axis of the bobbin 4 or substantially parallel to a generatrix of the bobbin when the yarn package is a cone. A yarn 1 is passed through a fulcrum guide 11 and a traverse guide 10 and is wound on the bobbin 4 to form a yarn package 5 while the yarn is being traversed by the traverse guide 10.

Figure 3A:
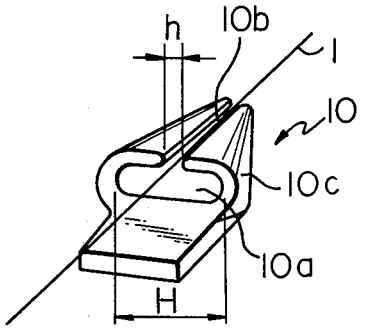
FIGS. 3A and 3B are perspective views of examples of a traverse guide utilized in a yarn winding apparatus of the present invention.

A traverse guide as shown in FIG. 3(A) comprises a tube-shaped yarn holding portion 10*a*, the front end of which portion is converged and an opening 10*b* provided in an upper part of the yarn holding portion 10*a*. The width H of the yarn holding portion 10*a* is wider than the width h of the opening 10*b*. The sectional shape of the traverse guide 10 taken along a plane perpendicular to the yarn running direction, is C-shaped.

Figure 3B:
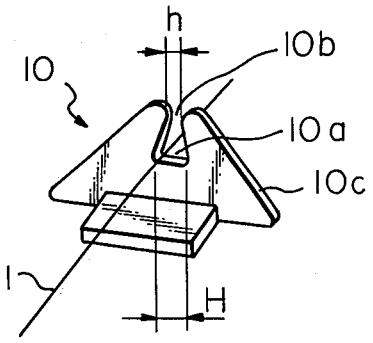

Another embodiment of a traverse guide, as shown in FIG. 3(B), is made of a plate member substantially formed in a triangular shape and provided with a groove for serving as a yarn holding portion 10*a*. The width H of the bottom of the groove, i.e., yarn holding portion 10*a*, is wider than the width h of the opening 10*b* of the groove.

The traverse guide 10 cooperates with the yarn catching guide, which is explained in detail later, and the traverse guide 10 is formed so as to disengage a yarn 1 from the traverse guide 10 easily when the traverse guide 10 is traversed to and fro. Further, the traverse guide 10 is provided with two inclined surfaces 10*c* on both sides, so that the traverse guide can easily catch a yarn which has been released from the fixed guide and the yarn is put onto the yarn holding portion 10*a*.

In a winding apparatus of the present invention, a rotary traverse drum may be used, which is provided with a helical groove in a cylindrical surface of the drum.

Figure 4:
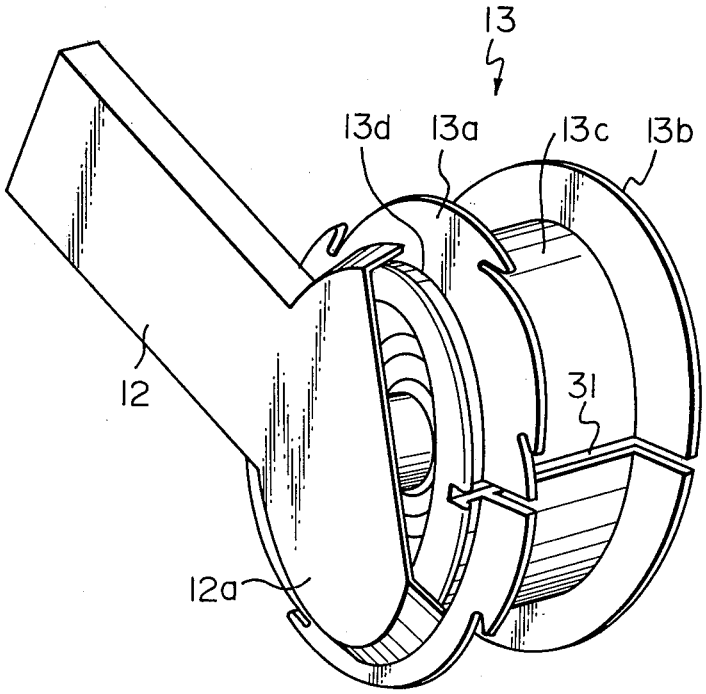
FIG. 4 is a perspective view of an example of a waste spool utilized in a yarn winding apparatus of the present invention.
Figure 5:
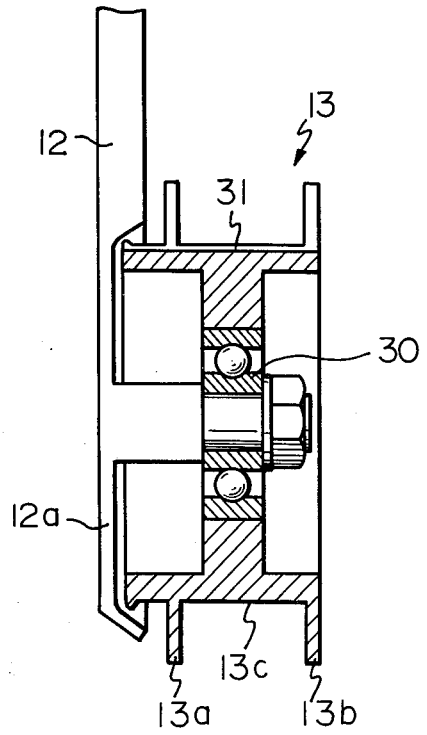
FIG. 5 is a cross sectional view of a waste spool illustrated in FIG. 4.

As shown in FIGS. 4 and 5, a waste spool 13 is rotatably supported by an arm 12 through a bearing means 30, and is pressed to a waste spool driving disk 15 (FIG. 1) so that it is surface-driven by the disk 15. The arm 12 (FIG. 1) is swung by the rotation of the shaft 14 (see FIG. 1), so that it can become engaged with and disengaged from the waste spool driving disk 15. In FIGS. 4 and 5, a waste spool 13 comprises a flange 13*a* with a yarn catching finger or fingers, another flange 13*b* which is not provided with a yarn catching finger, a yarn winding portion 13*c* and an auxiliary yarn winding portion 13*d*. Further, a waste spool 13 is provided with a slit 31 for cutting a yarn. A cap 12*a* is provided at a free end of the arm 12, which cap partially covers the auxiliary yarn winding portion 13*d* so as to easily remove the waste yarn. According to an embodiment of a waste spool, as shown in FIGS. 4 and 5, the diameter of a yarn winding portion 13*c* is almost equal to that of the auxiliary yarn winding portion 13*d*. However, it is not necessary that they be similar to each other in diameter. It is only necessary that the waste spool has two yarn winding portions which are disposed at both sides of the flange 13*a* with a yarn catching finger(s), i.e. a flange 13*a* with a yarn catching finger is positioned between two yarn winding portions.

Figure 6:
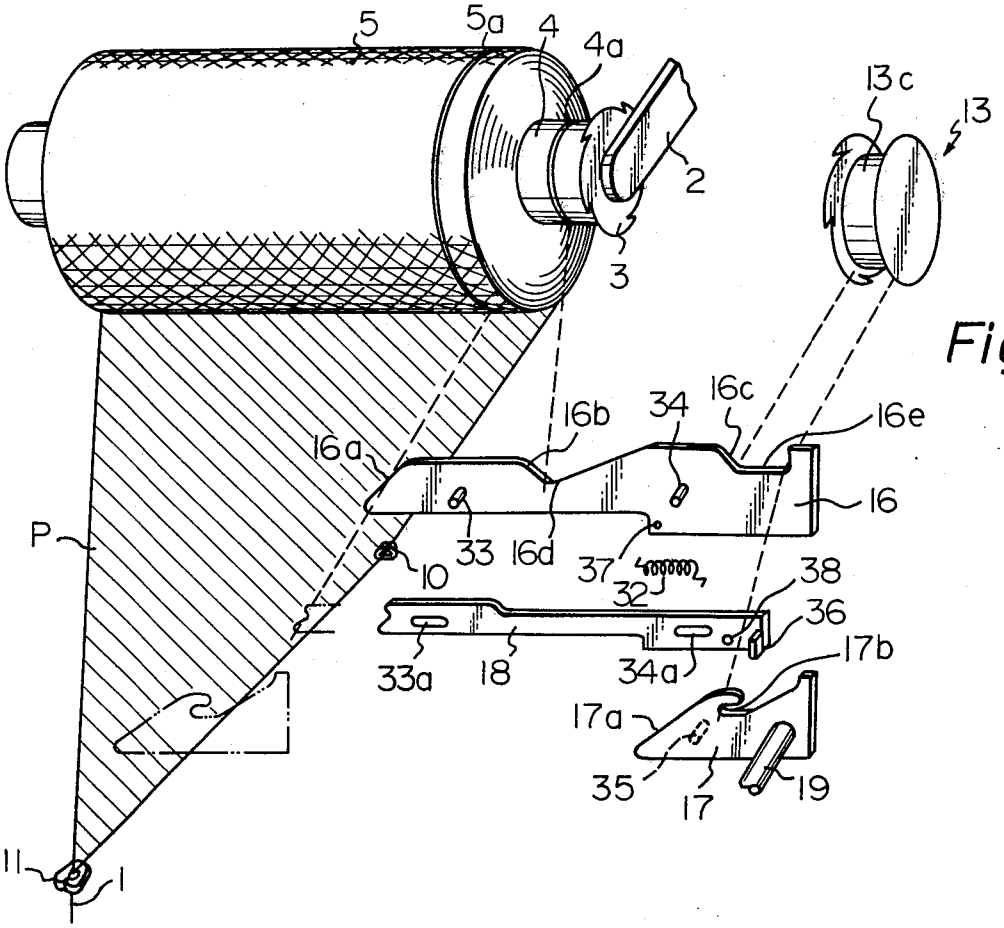
FIG. 6 is a diagrammatic perspective view which illustrates the locational relationships between the main parts in the yarn transferring section.

As illustrated in FIGS. 1 and 6, a fixed guide 16 is fixed on an upper surface of a cam box so as to be arranged substantially parallel to the moving direction of a traverse guide 10. The fixed guide 16 is positioned to one side of the traverse region P, which region is defined by the fulcrum guide 11 and by both sides of the traverse motion of the traverse guide 10, so that the fixed guide 16 does not contact the traverse region P (see FIG. 1). However, a free end portion of the fixed guide 16 covers a part of the traverse region P. The free end portion of the fixed guide 16 has an inclined portion 16*a*, the inclination of which is such that the height of the inclined portion increases towards the end opposite to the free end of the guide 16. Further the fixed guide 16 has a groove 16*d* which is located at a position facing an end portion of a bobbin 4 wherein a transfer tail yarn 4*a* (FIG. 6) is formed and a wall 16*b* of the groove 16*d* is inclined. The fixed guide 16 has another groove 16*e* which is located at a position facing a yarn winding portion 13*c* of the waste spool 13 and a wall 16*c* of the groove is also inclined. The length of the fixed guide 16 extends from a position in line with the end near the waste spool 13 of a yarn package 5 on the bobbin 4 to a position in line with the flange 13*b* without a yarn catching finger of the waste spool 13.

A yarn catching guide 17 is movable along the fixed guide 16 from a position in line with the waste spool 13 to the traverse region P and vice versa. At the front end (the end nearest the bobbin) of the yarn catching guide 17, is a slope 17*a*. When the slope 17*a* reaches the traverse region P, a part of the slope 17*a* becomes positioned under the traverse region P, whereas the remaining part of the slope 17*a* becomes positioned above the traverse region P. A hook portion 17*b* is formed at the upper part of the slope 17*a* so that the hook portion 17*b* connects with the upper end of the slope 17*a*. The bottom of the hook portion 17*b* is designed so that it is located at a position higher than the opening 10*b* of the traverse guide 10. The hook portion 17*b* of the yarn catching guide 17 is movable between a position located further into the traverse region P than the position at which the front end of the inclined portion 16*a* of the fixed guide 16 is located, and a position in line with the groove 16*e* of the fixed guide 16.

A movable guide 18 (FIG. 6) has two elongated holes 33*a* and 34*a* which are respectively arranged to correspond to fixed pins 33 and 34 planted on a side of the fixed guide 16. The pins 33 and 34 are respectively engaged with the elongated holes 33*a* and 34*a*, so that the movable guide 18 is attached to the fixed guide 16. A spring 32 is disposed between the fixed guide 16 and the movable guide 18 in such a manner that one end of the spring 32 is engaged with a hole 37 in the fixed guide 16 and the other end of the spring 32 is engaged with a hole 38 in the movable guide 18, so that the movable guide 18 is always urged to move toward the traverse region P, i.e. toward the lefthand direction in FIG. 6.

On the other hand, a pin 35 is provided on the yarn catching guide 17, and the pin is engaged with a projection 36 disposed on the right end (i.e. the end being positioned away from the traverse region P) of the movable guide 18, when the yarn catching guide 17 is displaced in a righthand direction in FIG. 6, so that the movable guide 18 is displaced in a righthand direction, i.e. the direction away from the traverse region, against the force of the spring 32. When the yarn catching guide 17 is located at the righthand position, indicated by a solid line figure of the guide 17 in FIG. 6, the front end of the movable guide 18 is also located at the righthand position, indicated by a solid line figure of the guide 18 in FIG. 6. However, when the yarn catching guide 17 is located at the lefthand position, indicated by a dot-and-dash line figure of the guide 17 in FIG. 6, the front end of the movable guide 18 is also located at a position wherein at least a part of the front end of the movable guide 18 projects beyond the inclined portion 16*a* of the fixed guide 16. Thus, the movable guide 18 cooperates with the yarn catching guide 17 so that its position is changed in accordance with the position of the yarn catching guide 17.

The driving mechanism for the yarn catching guide will now be explained, with reference to FIG. 1.

The yarn catching guide 17 is secured to a collar 20 via an arm 19. The collar 20 is rotatably mounted on a shaft 21 and is limited in its movement in the longitudinal direction of the shaft 21 by two stop bands 22*a* and 22*b*. When an operation for transferring a yarn between a bobbin 4 and a waste spool 13 is taking place, the yarn catching guide 17 is moved along the surface of the cam box 9, together with the shaft 21 which is substantially parallel to the axis of the bobbin 4.

The shaft 21 is provided so as not to rotate, and is moved backwards and forwards in a longitudinal direction by a motor 23 through a pinion 24 and a rack 25. Signals for controlling the movement of the shaft 21 are obtained from a dog 21*a* secured to the shaft 21 which dog pushes limit switches 26, 27, 28 and 29 fixed on the frame of the apparatus. The stop position and the return position of the shaft are determined by the signals. The motor 23 is a variable speed motor which can be set at various speed values. Instead of this motor, a motor rotating at a constant speed in one direction only may be utilized in combination with a speed change gear and a mechanism for changing rotary movement to reciprocal linear movement in order to drive the shaft 21. Further, a mechanism comprising a hydraulic cylinder and a solenoid operated valve may be utilized.

Now, the yarn transferring operation will be explained in detail.

Figure 7:
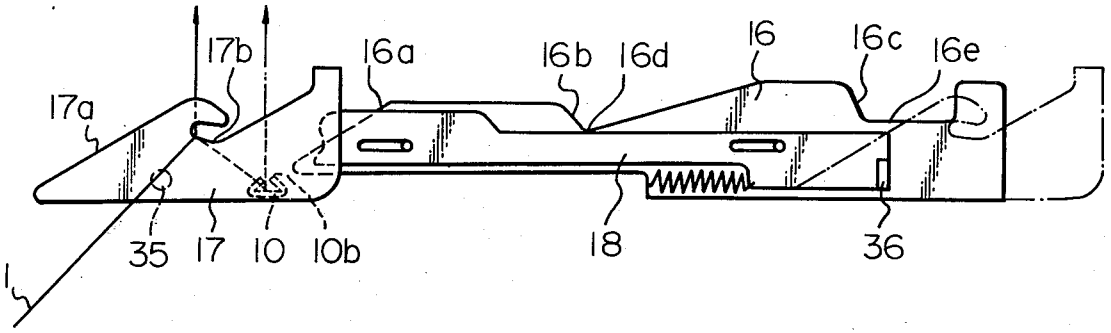
FIGS. 7 and 8 are elevational views which are utilized to explain the operations of the members located in the yarn transferring section when the yarn is transferred from a bobbin to a waste spool, in FIG. 7 the yarn is caught and in FIG. 8 the members are returned to an intermediate position.

When a yarn package 5 formed in the winding section W becomes a full package, as shown in FIGS. 1 and 2, firstly a waste spool 13 is allowed to descend and make contact with the waste spool driving disk 15, thereby starting the waste spool rotating. Then, the yarn catching guide 17 is activated and starts to move in a lefthand direction, so that the yarn catching guide 17 is moved until it reaches a position wherein the hook portion 17*b* of the yarn catching guide 17 is past the front end of the inclined portion 16*a* of the fixed guide 16 and enters into the traverse region P, as illustrated in FIG. 7. The position of the yarn catching guide 17 at this time is determined by a limit switch 29 shown in FIG. 1. By such movement of the yarn catching guide 17, the projection 36 of the movable guide 18 which is engaged with the pin 35 of the yarn catching guide 17 is disengaged, so that the movable guide 18 is moved in the lefthand direction by the resilience of the spring 32. As a result, the front end of the movable guide 18 is located at a position wherein a part of the front end of the movable guide projects past the inclined portion 16*a* of the fixed guide 16. On the other hand, the traverse guide 10 is being moved from left to right and encounters the yarn catching guide which is moving in the lefthand direction or which has been stopped. Further, when the traverse guide moves in the righthand direction, the yarn 1 guided by the traverse guide rides on and passes over the slope 17*a* of the yarn catching guide 17, and then enters into the hook portion 17*b* which has a bottom level that is higher than that of the opening 10*b* of the traverse guide 10 (see the yarn passage illustrated by the two-dot-and-dash lines in FIG. 7). When the yarn 1 enters into the hook portion 17*b* of the yarn catching guide, the direction of movement of the traverse guide 10 is changed. When the yarn guide 10 is moved in the lefthand direction, the yarn 1 becomes disengaged from the traverse guide 10 (see the yarn passage illustrated by a solid line in FIG. 7).

After the yarn catching guide 17 catches the yarn 1 at the position illustrated in FIG. 7, it immediately returns to a stand by position indicated on the righthand side of FIG. 7 and illustrated by a dot-and-dash line figure.

Figure 8:
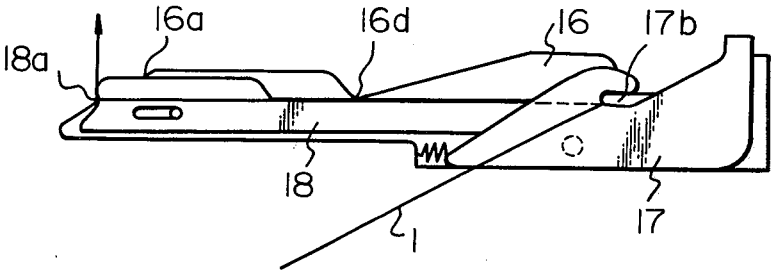
Figure 9:
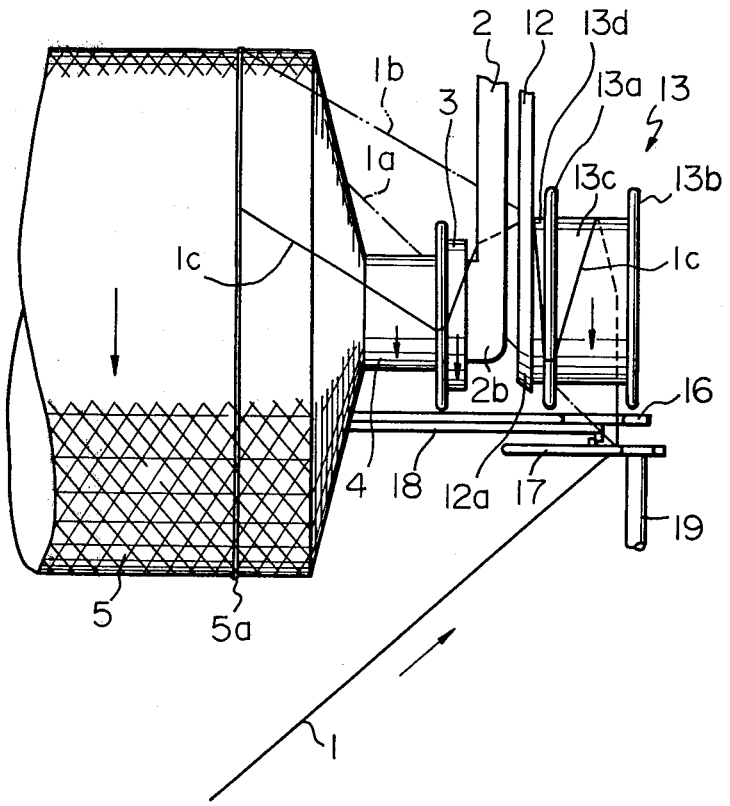
FIG. 9 is a plan view by which the operational condition of a yarn is explained.

As shown in FIG. 8, when the yarn catching guide 17 is moved in a righthand direction, the yarn 1 passes through the fulcrum guide 11 and the hook portion 17*b* of the yarn catching guide 17 becomes temporarily engaged with a recess 18*a* in the front end of the movable guide 18, so that the yarn 1 is wound on an end portion of the yarn package 5 to form a reserve winding 5*a* (see FIGS. 6 and 9). When the yarn catching guide 17 is moved further in a righthand direction from the position illustrated in FIG. 8 to the stand by position (illustrated by a dot-and-dash figure in FIG. 7), the pin 35 of the yarn catching guide 17 engages with the projection 36 of the movable guide 18, so that the movable guide 18 is moved in a righthand direction together with the yarn catching guide 17. Therefore the recess 18*a* of the front end of the movable guide 18 is moved, in a righthand direction, from a position wherein the recess 18*a* projects from the inclined portion 16*a* of the fixed guide 16 to a position wherein the recess 18*a* does not project from the inclined portion 16*a*. Consequently, the yarn which has been engaged with the recess 18*a* is released from the recess 18*a* and moves in a righthand direction along the inclined portion 16*a*, passes over the groove 16*d* and reaches the groove 16*e* which faces the hook portion 17*b* of the yarn catching guide 17 at this time. Then the yarn 1 is caught by a yarn catching finger or claw of a flange 13*a* of the waste spool 13, so that the yarn is wound on the yarn winding portion 13*c* of the waste spool 13.

Referring to FIG. 9, the above-mentioned movement of the yarn will be explained in detail.

The yarn 1 released from the recess 18*a* in the front end of the movable guide 18 runs in a yarn passage 1*a* illustrated by a single dot-and-dash line in FIG. 9 while the bobbin rotates in a direction illustrated by an arrow in FIG. 9. Then, the yarn 1 is caught by a yarn catching finger in the flange 13*a* of the waste spool 13. Further, in accordance with the rotations of the bobbin 4 and the waste spool 13, the yarn 1 moves along the circumference of the cap 12*a* and reaches the base portion of the arm 12, so that the yarn 1 runs in a yarn passage 1*b*, illustrated by a two-dot-and-dash line in FIG. 9. When the bobbin 4 and the waste spool 13 further rotate, the yarn 1 is engaged with the bobbin chuck 3 and is wound on both the auxiliary yarn winding portion 13*d* and the yarn winding portion 13*c*, so that the yarn 1 runs in a yarn passage 1*c*, illustrated by a solid line in FIG. 9. Since the movement of the yarn 1 is limited by the cradle 2 and the arm 12, the yarn will be broken in the meantime between the bobbin chuck 3 and the flange 13*a* of the waste spool 13. Then the yarn 1 extending from the fulcrum guide 11 is wound on the yarn winding portion 13*c* of the waste spool 13. Thus, the yarn transferring operation from the bobbin to the waste spool is completed. Regarding the yarn catching guide 17, after it returns to the stand by position, illustrated by a dot-and-dash line in FIG. 7, it moves backwards and forwards between two positions which are determined by the limit switches 26 and 27 (see in FIG. 1), so that the traverse motion of the yarn wound on the yarn winding portion 13*c* of the waste spool 13 is obtained.

After the yarn transferring operation from the bobbin 4 to the waste spool 13 is completed the cradle 2 is raised in order to disengage the full yarn package 5 from the driving roller 7, and the bobbin 4 with the full package 5 is doffed from the bobbin chuck 3, and an empty bobbin is donned to the bobbin chuck 3.

Hereinafter, a yarn transferring operation from a waste spool to an empty bobbin will be explained in detail.

Figure 10:
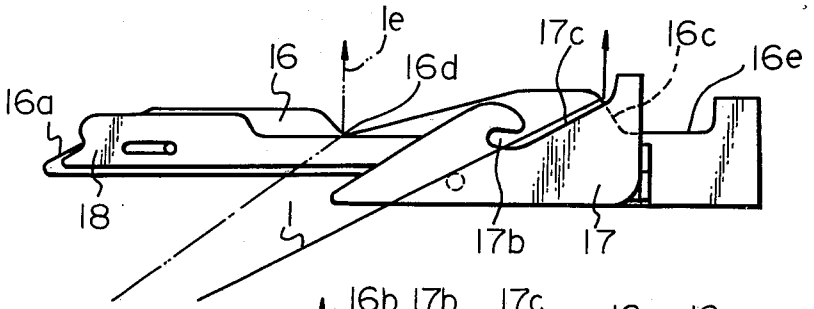
FIGS. 10 through 12 are elevational views which are utilized to explain the operation of the members located at the yarn transferring section when the yarn is transferred from a waste spool to an empty bobbin.
Figure 12:
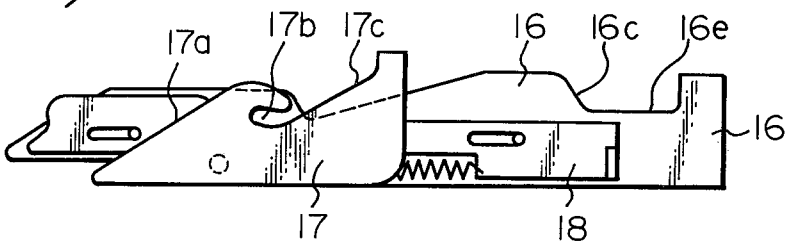
Figure 12:
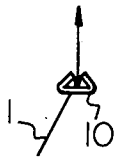

After exchanging a full bobbin for an empty bobbin, the driving of the empty bobbin is started. When the circumferencial speed of the empty bobbin reaches a normal winding speed, the yarn catching guide 17 is moved from the stand by position to the traverse region, i.e. it is moved in a lefthand direction, as shown in FIG. 10. In accordance with the movement of the yarn catching guide 17, the yarn, which was being wound on the yarn winding portion 13*c* of the waste spool 13, is lifted along the wall 16*c* of the groove 16*e* in the fixed guide 16 by the second slope 17*c* connected to the hook portion 17*b* of the yarn catching guide 17. The yarn passage of the yarn at this time is illustrated by a solid line in FIG. 10. In this state, the yarn is still wound on the yarn winding portion 13*c* of the waste spool 13. When the yarn catching guide 17 is further moved in a lefthand direction, the yarn 1 is further lifted by means of the second slope and then is instantaneously released from the wall 16*c* of the fixed guide 16. Thereafter the yarn released from the wall 16*c* passes over the yarn catching guide 17, and then the yarn is moved toward the groove 16*d* of the fixed guide 16. The yarn released from the wall 16*c* and moving toward the groove 16*d* is caught by a yarn catching finger of the flange 13*a* of the waste spool 13, and then the yarn engages with the groove 16*d*. The passage of the yarn at this time is illustrated by a two-dot-and-dash line in FIG. 10. On the other hand, at the proximity of the waste spool 13, the yarn is moved along the circumference of the cap 12*a* to reach the base portion of the arm 12 in accordance with the rotation of the waste spool 13. The yarn passage 1*d* at this state is illustrated by a two-dot-and-dash line in FIG. 13. Since the yarn intersects the bobbin chuck 3, the yarn is also caught by a yarn catching finger of the bobbin chuck 3, and the yarn 1 grasped by the catching finger wraps around the empty bobbin 4 as the empty bobbin rotates. A part of the yarn extending to the waste spool 13 passes through the base portion of the arm 12 and is wound on the auxiliary yarn winding portion 13*d* of the waste spool. The yarn passage 1*e* of the yarn 1 in this condition is illustrated by a solid line in FIG. 13. The yarn extending to the waste spool 13 will be quickly broken at a position between the waste spool 13 and the empty bobbin 4 since the yarn located at the position is subjected to a high tension caused by the rotation of the empty bobbin and the waste spool. Thus, the yarn transferring operation from the waste spool to the empty bobbin will be finished. On the other hand, a part of the yarn extending from the fulcrum guide 11 and being wound on the empty bobbin 4 has been limited in its position by the groove 16*d* of the fixed guide 16, and the yarn passage 1*e* of the yarn in this state is illustrated by a two-dot-and-dash line in FIG. 10. During the time the yarn is limited in the position of the yarn passage 1*e*, a transfer tail winding 4*a* is formed on the empty bobbin 4 near the end of the bobbin (see FIG. 6). Simultaneously, the yarn catching guide 17 is moving in a lefthand direction toward the traverse region, and the yarn 1 is lifted along the wall 16*b*' of the groove 16*d* in the fixed guide 16 by the first slope 17*a* in the front end of the yarn catching guide 17 and is released from the groove 16*d*. The released yarn 1 is moved to a position wherein the yarn is extended from the fulcrum guide 11 to the bobbin 4 in a yarn passage perpendicular to the axis of the bobbin 4. While the yarn is moving to the above-mentioned position, the yarn is caught by the traverse guide 10, and thereafter the yarn is wound on the bobbin under the normal traverse motion to form a yarn package. The yarn catching guide 17 is moved until it reaches a position wherein the yarn is released without fail from the wall 16*b* of the groove 16*d* in the fixed guide 16 and then the catching guide 17 is stopped, as shown in FIG. 12. The stop position of the yarn catching guide is determined by the limit switch 28, shown in FIG. 1. The yarn catching guide stopping at the position, as shown in FIG. 12, is again moved in a righthand direction to the stand by position, and after reaching the waiting position, the yarn catching guide stands by for the next yarn transferring operation. During the stand by time, the motor 23 is stopped. On the other hand, the waste spool 13 is disengaged from the waste spool driving disk 15 to stop rotation of the waste spool. In this state, the waste yarn wound on the yarn winding portion 13*c* and the auxiliary yarn winding portion 13*d* is manually cut by an appropriate cutting means through the slit 31 and is removed.

According to the above-mentioned embodiment, a fixed guide 16, a movable guide 18 and a yarn catching guide 17 in the yarn transferring section T are respectively disposed between a traverse guide 10 and a fulcrum guide 11. However, they may be disposed between a traverse guide and a bobbin. Further, the position of the movable guide is not necessarily limited to that between a fixed guide and a yarn catching guide. The movable guide may be arranged near a side of a fixed guide independently from the yarn catching guide. The driving system for the bobbin is not always limited to a surface driving system, and a spindle driving system may be utilized wherein a bobbin is supported on a spindle positively rotating at a speed synchronized with the yarn feeding speed. The driving system for the waste spool can also be adapted to a spindle driving system.

The movable guide is not always limited to the specific embodiment mentioned before, and the movable guide may be arranged independently from a fixed guide. It is not always necessary to provide a recess in the front end of the movable guide. The movable guide can be designed in combination with a fixed guide, so as to temporarily engage with a yarn to form a reserve winding.

Figure 14:
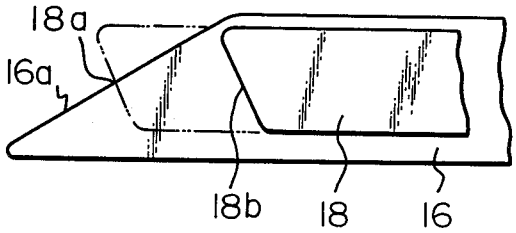
FIGS. 14 and 15 are side views which illustrate examples of a movable guide.

For example, according to an embodiment as shown in FIG. 14, a movable guide 18 has an inclined portion 18*b* on the front end thereof, the inclination of which is opposite to that of the inclined portion 16*a* of the fixed guide 16. The movable guide 18 of this embodiment can be moved in a horizontal direction, similar to the movable guide explained in the first embodiment. When the front end of the movable guide 18 slightly projects from the inclined portion 16*a* of the fixed guide 16, a recess 18*a* is formed by the inclined portion 16*a* and the inclined portion 18*b* in combination. A yarn will temporarily be engaged in this recess 18*a*.

Figure 15:
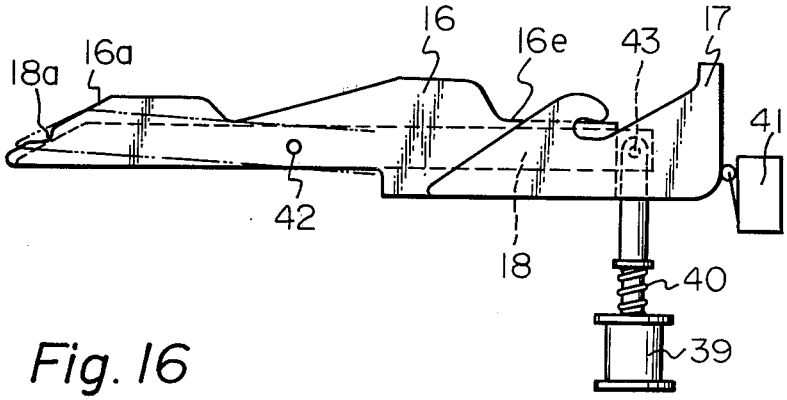

According to another embodiment as shown in FIG. 15, a fixed guide 16 is provided with a recess 18*a* in the center part of the inclined portion 16*a*. A movable guide 18 is swingably supported by the fixed guide 16 via a pin 42. One end of the movable guide 18 on the bobbin side is a free end, and the other end on the waste spool side is connected to a solenoid 39 via a pin 43. The solenoid 39 is urged upwardly by means of a spring 40 and is actuated by a limit switch 41 secured adjacent to the stand by position of a yarn catching guide 17, so as to contact with the yarn catching guide 17.

Figure 16:
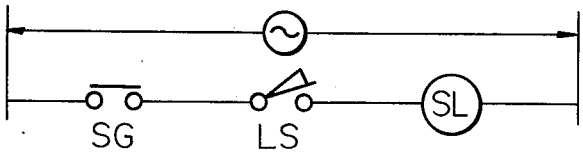
FIG. 16 is an electric circuit diagram which is utilized to explain the operational principle of the movable guide illustrated in FIG. 15.

Referring to FIG. 16, a contact SG is actuated by an external signal and is closed during the yarn transferring operation from the bobbin to the waste spool. A contact LS is closed when the limit switch 41 is actuated. The character SL designates a solenoid coil. According to the circuit illustrated in FIG. 16, since the solenoid 39 is not energized during the time a yarn is being wound on a bobbin, the movable guide 18 is located at a position illustrated by a dotted line in FIG. 15 due to the force of a spring 40. After catching a yarn, the yarn catching guide 17 returns to the waiting position, so that the guide 17 actuates the limit switch 41, thereby closing the contact LS, whereas the other contact SG is kept in a closed state. As a result, the solenoid 39 is energized and the movable guide 18 is moved to a position illustrated by a two-dot-and-dash line in FIG. 15. While the movable guide is moved to the above-mentioned position, the yarn, which has been engaged with the recess 18*a* in the inclined portion 16*a* of the fixed guide 16, is released from the recess 18*a*.

Figure 17:
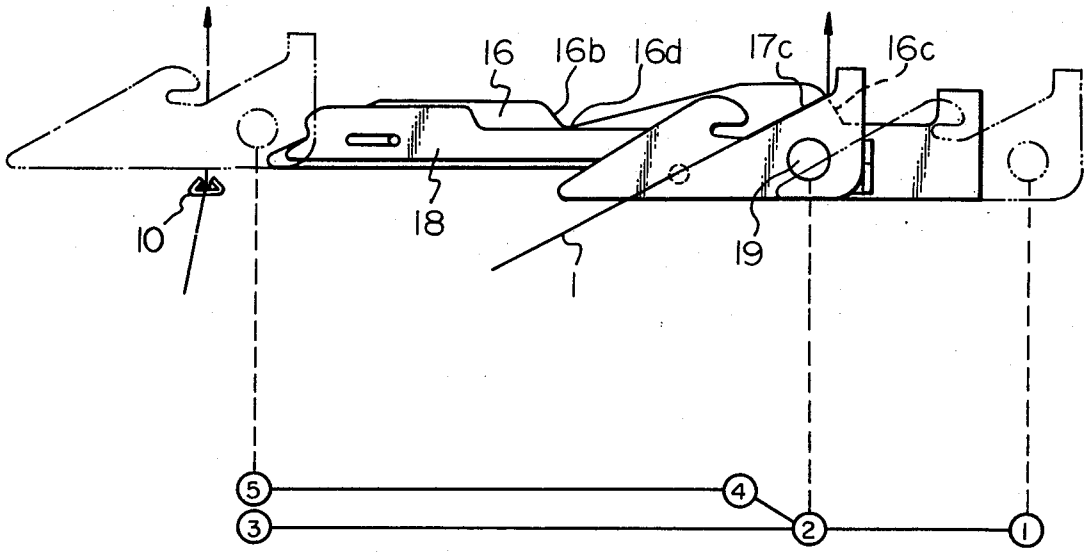
FIG. 17 is an elevational view which is utilized to explain the behavior of a yarn catching guide which trails another moving passage.

Referring to FIGS. 1 and 17, the movement of the yarn catching guide shown in FIG. 17 will now be explained. According to this embodiment, a guide plate 44 is disposed as shown in FIG. 1, but the limit switch 28 in FIG. 1 is omitted. The guide plate 44 is connected to a drive source such as an air cylinder, through a known appropriate connecting means, such as link mechanism (not shown), so that the guide plate can be vertically moved and located alternately at an upper position and a lower position. When the guide plate 44 is in the upper position, the guide plate 44 is engaged with an arm 19 which is moving toward the traverse region to the left and which is pivoted to the shaft 21; accordingly the arm is lifted by the inclined surface 44*a* of the guide plate. Consequently, the yarn catching guide 17, which is attached to the arm 19, is also lifted. As a result, in spite of the yarn catching guide 17 being moved to the left, it is located in a position above the traverse region P, and hence it does not make contact with the yarn which is moved by the traverse guide 10. Consequently, the guide plate 44 is driven so that it is located at the upper position only during a yarn transferring operation from a waste spool to a bobbin and during the remaining time it is located at the lower position.

A yarn transferring operation will now be explained in detail based on FIG. 17.

In the case of transferring a yarn from a bobbin to a waste spool, the yarn catching guide 17 is horizontally moved backward and forward between the stand by position illustrated by a two-dot-and-dash line in FIG. 17 and a position facing the limit switch 29 illustrated in FIG. 1. That is, the movement of the yarn catching guide is from the stand by position ①, to position ②, to position ③, to position ②, and to the stand by position ① (see FIG. 17). In this case, the guide plate 44 is at the lower position. During the above-mentioned movement, the yarn catching guide 17 catches a yarn being moved backward and forward by a traverse guide with its hook portion and then the guide 17 is stopped at the stand by position. This operation is the same as explained in relation with FIGS. 7 to 9.

In the case of transferring a yarn from a waste spool to a bobbin, the horizontal moving distance in which a yarn catching guide 17 is moved backward and forward is the same as the moving distance of the yarn catching guide in the above-mentioned transferring operation from a bobbin to a waste spool. However, since the guide plate 44 is located at the upper position, the arm 19 provided with the yarn catching guide 17 is lifted along the inclined surface 44*a* of the guide plate 44. Therefore, the movement of the yarn catching guide 17 is from the stand by position ①, to position ②, to position ④, to position ⑤, to position ④, to position ②, and to the stand by position ① (see FIG. 17). That is, in the position ②, the yarn 1 is released from the wall 16*c* of the fixed guide 16 by the second slope 17*c* of the yarn catching guide, and passes over the front portion of the yarn catching guide 17, and then reaches the groove 16*d* of the fixed guide 16. On the other hand, the yarn catching guide 17 is moved to the left where it is lifted along the inclined surface 44*a* of the guide plate 44, so that the yarn catching guide 17 releases with its slope 17*a* (i.e. the first slope) from the wall 16*b* of the fixed guide 16 the yarn which has been in the groove 16*d* of the fixed guide 16. The released yarn 1 is moved to the left, toward the traverse region, by the yarn catching guide 17 and is caught by the traverse guide 10 in the traverse region. After the yarn catching guide reaches the position illustrated by a two-dot-and-dash line in FIG. 17, where the yarn catching guide is located above the traverse region, it is returned to the stand by position through the same course as it took from the stand ty position to the above-mentioned end position.

Figure 18:
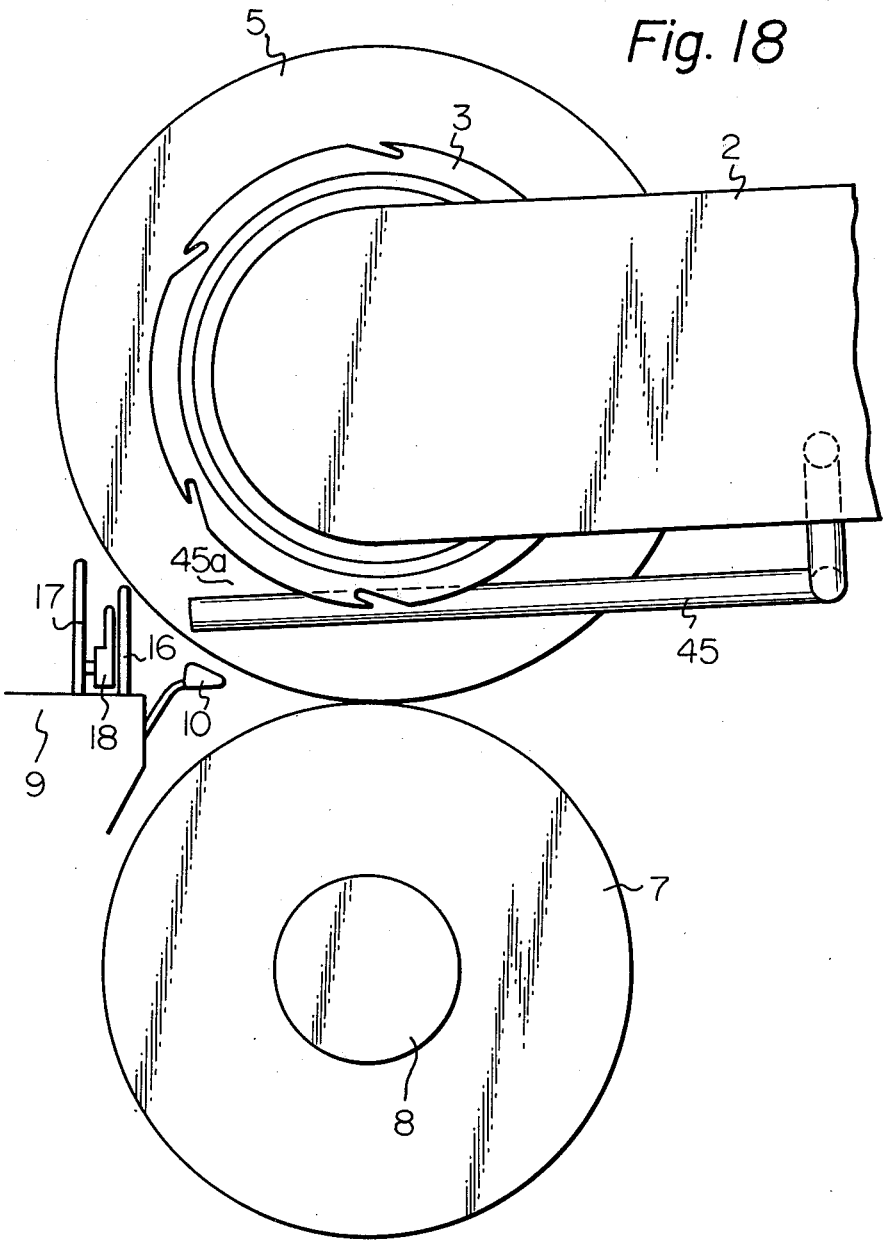
FIG. 18 is a side view of a yarn winding apparatus which has a cradle different from that illustrated in FIG. 1.
Figure 19:
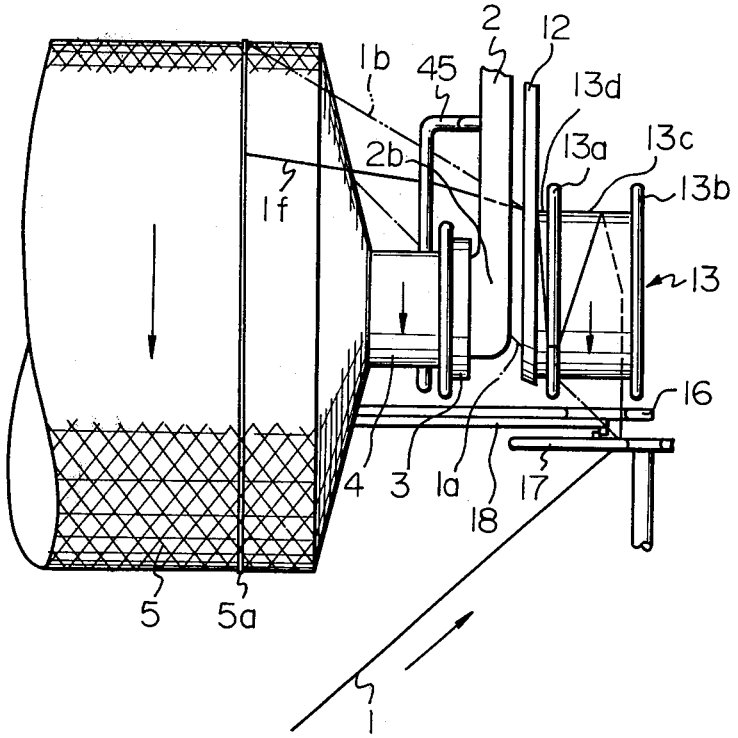
FIG. 19 is a plan view which illustrates the yarn moving condition in a yarn winding portion illustrated in FIG. 18.

According to an embodiment illustrated in FIG. 18, a guide 45 is secured to a cradle 2 on the side of the bobbin in such a manner that the guide 45 does not contact the driving roller 7 even when an empty bobbin 4 held by the cradle 2 contacts the driving roller 7. When a yarn transferring operation from a full package 5 to a waste spool 13 takes place, the yarn 1 is guided along the lower surface of the guide 45 without the yarn being engaged with a yarn catching finger of the bobbin chuck 3. That is, as shown in FIG. 19, the yarn 1 released from the recess 18*a* of the movable guide 18 changes its yarn passage from a yarn passage 1*a*, illustrated by a dot-and-dash line, to a yarn passage 1*f*, illustrated by a solid line, through a passage 1*b*, illustrated by a two-dot-and-dash line, so that the yarn 1 is engaged with a yarn catching finger of the flange 13*a* of the waste spool 13. During the above-mentioned operation a part of the yarn extending between the bobbin and the waste spool passes under the guide 45 without engaging with a yarn catching finger of the bobbin chuck 3, and thereby the yarn 1 does not become entangled with the end portion 2*b* of the cradle 2. The yarn 1 is wound on the yarn winding portion 13*c*, the auxiliary yarn winding portion 13*d* and the end portion 5*a* of the yarn package 5 formed on the bobbin 4. As the bobbin 4 rotates, the tension in the yarn between the package and the waste spool is increased, and then, the yarn 1 is broken between the bobbin 4 and the waste spool. Thus the yarn transferring operation from a bobbin to a waste spool is completed. During this transferring operation, a yarn is prevented from being wound on a space between the bobbin chuck and the cradle by means of the guide 45.

Figure 11:
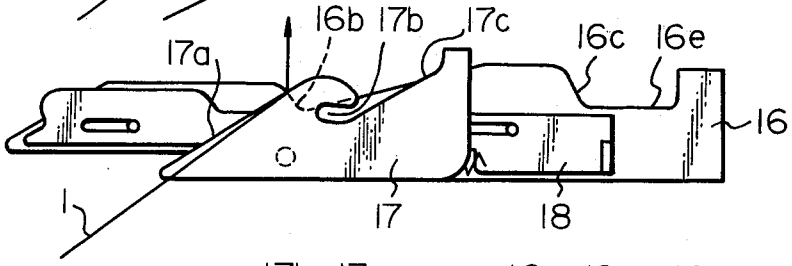

In the case of transferring a yarn from a waste spool to a bobbin, the yarn 1 released from an inclined portion 16*c* of the fixed guide 16, as shown in FIG. 10, is moved toward the bobbin through a gap 45*a* between the bobbin chuck 3 and the guide 45, as shown in FIG. 18, and then the yarn is engaged with a yarn catching finger of the bobbin chuck 3, and is wound on the bobbin 4 in the same way as explained in connection with FIGS. 11 and 12.

Figure 20:
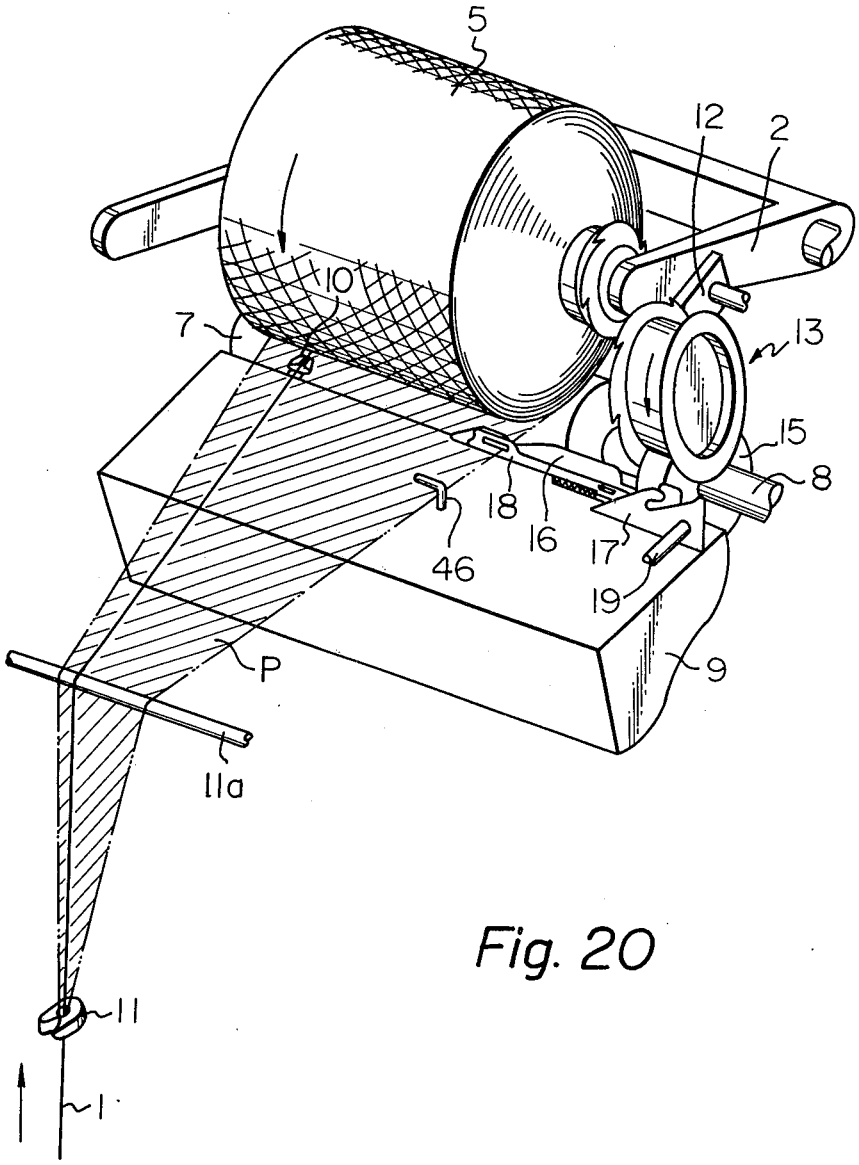
FIG. 20 is a perspective view of an embodiment of the present invention.

Another embodiment of the present invention is illustrated in FIG. 20. This embodiment is similar to the embodiment shown in FIG. 1, except for the following. That is, according to this embodiment, a traverse region, i.e. a traverse plane, is bent by the second fulcrum guide 11*a* and a yarn passage limiting guide 46 is added.

The second fulcrum guide 11*a* is a round rod which is arranged parallel to the moving direction of the traverse guide 10 and has a smooth surface along which the yarn is traversed to and fro. The second fulcrum guide 11*a* is disposed downstream from the first fulcrum guide 11, i.e. the second fulcrum guide 11*a* is located nearer to the bobbin than the first fulcrum guide 11.

The yarn passage limiting guide 46 is L-shaped and mounted on the upper surface of the cam box 9. The yarn passage limiting guide 46 is disposed at a position adjacent to the traverse region P on the side near the waste spool. The yarn passage limiting guide 46 is arranged in such a manner that when transferring a yarn from a waste spool to a bobbin, a yarn in a yarn passage extending from the yarn passage limiting guide 46 to the base portion of the cap 12*a* (see FIG. 4) is engaged with a yarn catching finger of the bobbin chuck 3. The height of the L-shaped yarn passage limiting guide 46 is determined so as to be in a position higher than a yarn passage extending between the second fulcrum guide 11*a* and the hook portion 17*b* of the yarn catching guide when the yarn catching guide 17 advances across the traverse region. The arm 19, having the yarn catching guide 17 attached to it, is designed so that the arm 19 does not contact the yarn passage limiting guide 46 when the arm 19 moves toward the traverse region. However, this design is not illustrated in the accompanying drawings. Consequently, in the case of transferring a yarn from a bobbin to a waste spool, the yarn passage limiting guide allows a yarn passage to form, similar to the yarn passage illustrated in FIG. 9, after the yarn catching guide returns to its stand by position, so that the yarn 1 passes through the first fulcrum guide 11, the second fulcrum guide 11*a*, the yarn passage limiting guide 46, and the hook portion 17*b* of the yarn catching guide 17 and is wound on a waste spool 13.

Figure 13:
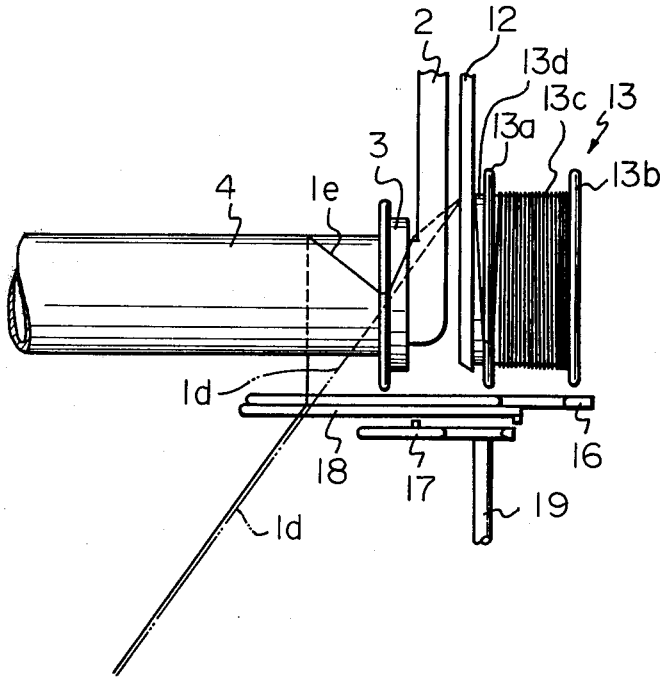
FIG. 13 is a plan view by which the operational condition of a yarn is explained.

In the case of transferring a yarn from a waste spool to a bobbin, the yarn passage limiting guide 46 allows a yarn passage to form, similar to the yarn passage in FIG. 13, so that the yarn is wound on a bobbin in the same way as explained in relation to FIG. 13. If a yarn passage limiting guide were not used, a yarn 1 released from a recess 16*c* of a fixed guide would not become engaged with a yarn catching finger of a bobbin chuck 3, so that a transferring of a yarn could not take place.

A yarn passage limiting guide 46 is effectively utilized in an apparatus illustrated in FIG. 1 when the distance between a bobbin 4 and a fulcrum guide 11 is large or when a gap between a bobbin and a waste spool 13 is large.

According to the above-mentioned embodiments, a bobbin chuck and a waste spool are each provided with a flange which has yarn catching fingers. However, the apparatus of the present invention is not limited by the embodiments. Instead of a yarn catching finger, a brush or a fabric with projections, which is already known, can be used.

Next, another embodiment of an arm supporting a waste spool will be explained.

Figure 21:
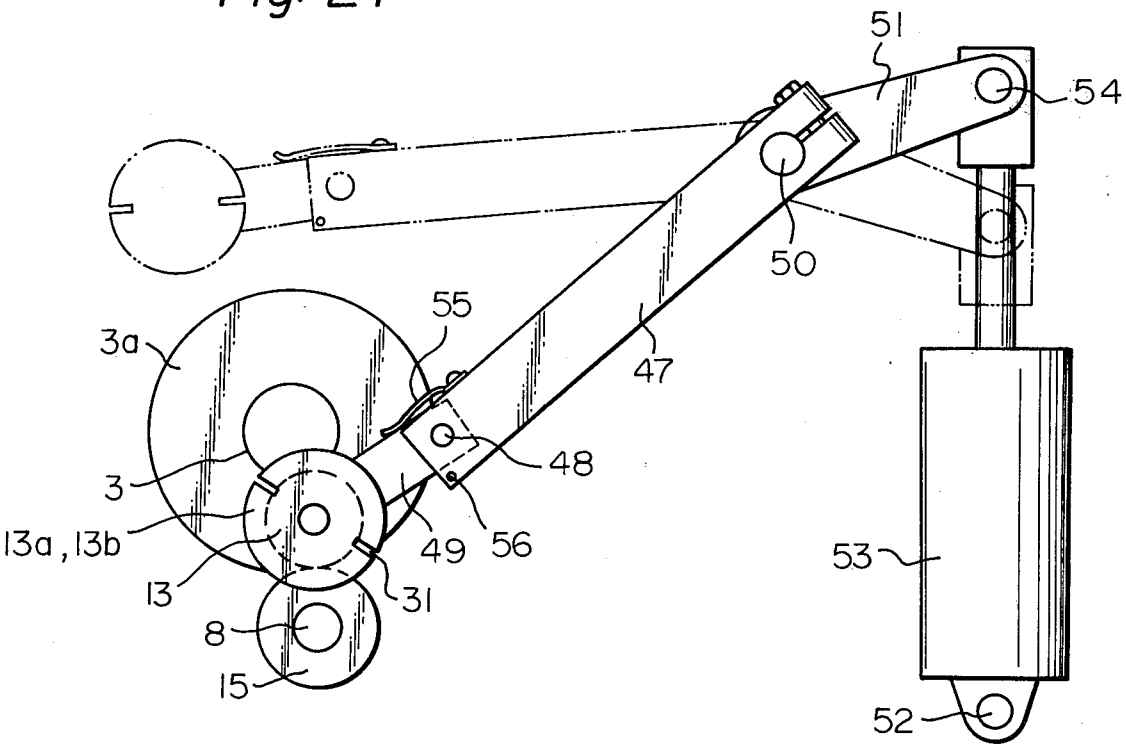
FIG. 21 is an elevational view which illustrates the construction of a waste spool support arm which is different from those illustrated in FIGS. 4 and 5.

As shown in FIG. 21, a waste spool 13 is rotatably supported via bearing means by a swing arm 49 which is swingably supported by a pivot 48 mounted on a semi-fixed arm 47. The waste spool 13 comprises a flange 13*b*, another flange 13*a* with yarn catching fingers and a yarn winding portion 13*c* (refer to FIGS. 4 and 5). The waste spool 13 is provided with slits 31 for cutting and removing a waste yarn. The semi-fixed arm 47 is secured to a rotary shaft 50 by means of split clamping. The shaft 50 is swingably supported to the bearing means (not shown) disposed in the machine frame. A lever 51 is secured to the rotary shaft 50 and is rotatably connected via a pin 54 to a piston rod of a means for driving the semi-fixed arm 47 which is formed in a fluid cylinder, such as a hydraulic cylinder 53 or a pneumatic cylinder, one end of which is swingably supported on the machine frame by means of a fixed pin 52.

Due to the actuation of the cylinder 53, the semi-fixed arm 47 is swingable between an operating position, illustrated by a solid line in FIG. 21, and a waiting position, illustrated by a two-dot-and-dash line in FIG. 21, and is able to alternately keep stationary at one of these positions. These positions respectively correspond to each end of the stroke of the cylinder 53. The semi-fixed arm 47 has a plate spring 55 and a stop pin 56. The plate spring 55 urges the swing arm 49 downward. As illustrated by a solid line, when the semi-fixed arm 47 is in the operating position, the waste spool 13 is pushed to a rotating waste spool driving disk 15 by the own weight of the waste spool 13 and the urging force of the spring 55, so that the waste spool 13 is surface driven. As a yarn is gradually wound on the waste spool 13, the swing arm 49 is gradually swung upwards against the spring force. When the semi-fixed arm 47 is in the waiting position, the swing arm 49 is in a state that the arm 49 engages with the stop pin 56. In the case that a sufficient pressure for surface driving the waste spool is obtained by the waste spool's own weight, it is not necessary to use a plate spring 55.

The pivot 48 and the lever 51 are respectively rigidly fastened to the semi-fixed arm 47, so that they form a rigid body. The hydraulic cylinder is designed to have a sufficiently large driving force for overcoming the force of the spring 55. Therefore, even if the distance between the pivot 48 and the waste spool 13 is long and two arms, i.e. the semi-fixed arm 47 and the swing arm 49, are used, the two arms can be fixed to act as a one piece member. The plate spring 55 allows absorption of the vibration of the waste spool 13.

While a yarn is being wound on a bobbin 4, the waste spool 13 is located at the waiting position illustrated by a two-dot-and-dash line in FIG. 21. When a full package 5 has just formed on the bobbin 4, the waste spool 13 is displaced to the operating position illustrated by a solid line, so that the waste spool 13 is driven by the waste spool driving roller. Such displacement of the waste spool is carried out by the hydrauric cylinder 53.

According to an apparatus of the present invention, when transferring a yarn from a bobbin to a waste spool or vice versa, an unstable tension region is not caused in the yarn where the yarn tension in the yarn may be excessively higher or lower. Therefore, the yarn transferring operation can be effected reliably and smoothly.

The variation of the yarn tension, when using an apparatus of the present invention, will now be explained in detail.

In the case of transferring a yarn from a bobbin to a waste spool, there are four main processes, i.e. (1) catching a yarn, (2) forming a reserve winding on a surface of a yarn package, (3) winding a yarn on a waste spool and (4) breaking a yarn.

In the first process, when a yarn catching guide 17 slightly enters into the traverse region P, the yarn catching guide comes into contact with a yarn guided by the traverse guide, and then the yarn is lifted along the first slope 17*a* of the yarn catching guide 17, so that the yarn falls into the hook portion 17*b* of the guide 17. At this moment, the yarn tension is slightly raised. However, when the traverse guide 10 changes its moving direction, the yarn is smoothly released from the traverse guide 10. Therefore, a rapid change from one yarn passage to another yarn passage by means of the traverse guide will not occur, and thereby a rapid change in yarn tension will not occur.

In the second process, the yarn catching guide is displaced from a state, illustrated in FIG. 7, to a state shown in FIG. 8. However, since the yarn has been released from the traverse guide, the length of a yarn passage does not excessively change, so that a rapid increase of a yarn tension is prevented.

In the third and fourth processes, the length of a yarn passage is slightly decreased when the yarn is moved to a yarn passage 1*a* in FIG. 9. As a result, the yarn tension is slightly decreased. However, at the next moment, the yarn is engaged with a yarn catching finger of the flange 13*a* of the waste spool, and the yarn is simultaneously wound on a yarn winding portion 13*c* and on an auxiliary yarn winding portion 13*d*; thereby the yarn is taken up at a speed higher than the feeding speed of the yarn. Consequently, the yarn tension is immediately recovered to a normal condition, i.e. an excessive decrease in yarn tension will not occur. Then, the yarn is engaged with a yarn catching finger of the bobbin chuck 3 (in the case of the embodiment as shown in FIG. 19, the yarn is slightly wound on the bobbin), and as a result, a new winding part of the yarn is formed between the bobbin chuck 3 and the auxiliary yarn winding portion 13*d* via the cradle 2. Consequently, the yarn portion extending between a bobbin and a waste spool is broken. In this process, the yarn will move by itself to a direction in which the yarn passage is shortened, so that the yarn tension is temporarily lowered. But, when the yarn tension is decreased, the yarn is caught by a yarn catching finger of the flange 13*a* in the waste spool 13, and then the yarn part connecting to a bobbin is gradually increased in yarn tension, so that the yarn is automatically broken between a bobbin and a waste spool. Therefore, the yarn transferring operation will not be unsuccessful.

The variation of the yarn tension is explained in detail hereinafter, in the case of transferring a yarn from a waste spool to an empty bobbin.

While the yarn is wound on a yarn winding portion 13*c* under an appropriate yarn tension, in a state which is illustrated in FIG. 10, the yarn tension is temporarily decreased when the yarn is instantaneously released from the wall 16*c* of the groove 16*e* in the fixed guide 16, because the yarn passage is shortened for a moment during the time the yarn is moving to the yarn passage, illustrated by a two-dot-and-dash line in FIG. 13. However, since the yarn is immediately engaged with a yarn catching finger of the bobbin chuck 3, the yarn tension will not excessively decrease. Therefore, the yarn can be smoothly transferred and wound on a bobbin. In this case, the yarn is temporarily engaged with a groove 16*d* in the fixed guide 16, so that the yarn is wound on the bobbin under a stable constant yarn tension to form a transfer tail yarn winding. Then, after the yarn is released from the groove 16*d* of the fixed guide 16 by the yarn catching guide 17, it is quickly caught by the traverse guide as it is moving towards the center of the bobbin. Thus, the normal winding operation is commenced.

We claim:

1. An apparatus for winding a yarn on a bobbin comprising:

a guide for serving as a fulcrum of the traverse motion of a yarn;

a mechanism for positively driving and holding said bobbin;

a traverse mechanism interposed between said bobbin and said fulcrum guide further comprising a traverse guide having a narrow opening and a wide yarn holding portion through which said yarn may travel and reciprocating means for traversing said traverse guide along the direction of the generatrix of said bobbin so as to form a yarn package on said bobbin, said yarn moving to and fro in accordance with said traverse guide forming a path between said fulcrum guide and said bobbin;

a yarn catching guide substantially parallel the moving direction of said traverse guide and substantially perpendicular to the plane of said yarn path, adjacent said traverse guide and movable along the moving direction of said traverse guide, having an inclined portion proximate said yarn path and having a hook portion adjacent said inclined portion for catching said yarn, said inclined portion positioned to intersect said yarn path, and said hook portion projecting away from said yarn path and being positioned more distant from the plane of said yarn path than said opening of said traverse guide.

2. A yarn winding apparatus according to claim 1, wherein the part of said yarn holding portion of said traverse guide proximate said bobbin is converged.

3. A yarn winding apparatus according to claim 1, wherein said traverse guide is made of a plate member.

4. A yarn winding apparatus according to claim 1, wherein said yarn holding portion of said traverse guide is formed with inclined surfaces so that the width of the portion of said wall proximate said opening is narrow and the width of the portion of said wall distant said opening is wide.

5. An apparatus for winding a yarn on a bobbin comprising:

a guide for serving as a fulcrum of the traverse motion of a yarn;

a mechanism for positively driving and holding said bobbin;

a traverse mechanism interposed between said bobbin and said fulcrum guide further comprising a traverse guide having a narrow opening and a wide yarn holding portion through which said yarn may travel and reciprocating means for traversing said traverse guide along the direction of the generatrix of said bobbin so as to form a yarn package on said bobbin, said yarn moving to and fro in accordance with said traverse guide forming a path between said fulcrum guide and said bobbin;

a waste spool which is disposed proximate and axially parallel said bobbin and on which said yarn is temporarily wound;

a mechanism for rotatably supporting said waste spool and for positively driving said waste spool;

a means for transferring said yarn further comprising:

a yarn catching guide substantially parallel the moving direction of said traverse guide and substantially perpendicular to the plane of said yarn path, adjacent said traverse guide, having an inclined portion proximate said yarn path and having a hook portion adjacent said inclined portion for catching said yarn, and said hook portion projecting away from said yarn path and positioned more distant from the plane of said yarn path than said opening of said traverse guide;

a fixed guide substantially parallel said yarn catching guide having an inclined portion projecting into an area proximate said yarn path, distant from said traverse guide; and a movable guide which is engaged with said fixed guide and which cooperates with said yarn catching guide;

said fixed guide being secured so as to extend substantially in parallel with the moving direction of said traverse guide and having a length substantially equal to that between a position aligned with a part of said bobbin and another position aligned with said waste spool; and said yarn catching guide being adjacent to said fixed guide and arranged movably along the lengthwise direction of said fixed guide so that said incline of said yarn catching guide intersects said yarn path and so that said hook portion is movable between a position proximate said yarn path, distant from said traverse guide and a position aligned with said waste spool.

6. A yarn winding apparatus according to claim 5, wherein said fixed guide has a groove formed in alignment with a yarn portion of said waste spool.

7. A yarn winding apparatus according to claim 5, wherein said fixed guide has a groove formed at a position facing a transfer tail yarn winding portion of said bobbin.

8. A yarn winding apparatus according to claim 5, wherein said fixed guide has a groove formed in that portion of the fixed guide aligned with a yarn winding portion of said waste spool and distant from said plane of said yarn path, the edges of said groove extending to a point beyond said hook portion of said yarn catching guide.

9. A yarn winding apparatus according to claim 5, wherein said waste spool supporting mechanism has a cradle at a position nearer said bobbin than said waste spool, and said waste spool includes an auxiliary yarn winding portion, a flange with a yarn catching finger, a yarn winding portion and another flange successively arranged from said cradle.

10. A yarn winding apparatus according to claim 5, wherein said waste spool has an auxiliary yarn winding portion, and a part of said auxiliary yarn winding portion is surrounded by a cap provided with a projection.

11. A yarn winding apparatus according to claim 5, wherein said waste spool is rotatably supported by means of a swingable swing arm, and said swing arm is swingably supported by means of a semi-fixed arm which is provided with a mechanism for swinging between the two positions and for securing thereto.

12. A yarn winding apparatus according to claim 5, wherein said bobbin holding mechanism includes a cradle for supporting one end of said bobbin located near said waste spool, and said cradle has a guide being adjacent to said bobbin and parallel to said cradle.

13. A yarn winding apparatus according to claim 5, which further comprises a yarn passage limiting guide disposed at a position adjacent to said traverse region and located on an elongation of a line extending between a base portion of a cap of said waste spool and a yarn catching finger formed on a bobbin chuck in said bobbin holding mechanism.

14. A yarn winding apparatus according to claim 5, wherein said movable guide is provided with a recess in the end proximate said yarn path.

15. A yarn winding apparatus according to claim 5, wherein said fixed guide is provided with a recess in the end proximate said yarn path.

16. A yarn winding apparatus according to claim 5, wherein the end of said fixed guide and the end of said movable guide proximate said yarn path form a recess in combination.

* * * * *